US007357223B2

(12) United States Patent
Penn

(10) Patent No.: US 7,357,223 B2
(45) **Date of Patent: *Apr. 15, 2008**

(54) PLATFORM LIFT APPARATUS WITH INTEGRATED LADDER FOR ACCESSING ATTIC STORAGE SPACE

(75) Inventor: Jay P. Penn, Redondo Beach, CA (US)

(73) Assignee: Spacelift Products, Inc., Redondo Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/605,625

(22) Filed: Nov. 28, 2006

(65) Prior Publication Data

US 2007/0095607 A1 May 3, 2007

Related U.S. Application Data

(63) Continuation of application No. 11/207,543, filed on Aug. 19, 2005, now Pat. No. 7,140,466, which is a continuation of application No. 10/814,395, filed on Mar. 30, 2004, now Pat. No. 6,962,236.

(60) Provisional application No. 60/526,568, filed on Dec. 2, 2003, provisional application No. 60/501,235, filed on Sep. 8, 2003.

(51) Int. Cl.
*E06C 9/00* (2006.01)

(52) U.S. Cl. ..... 182/77

(58) Field of Classification Search ..... 182/70, 182/77–81, 129, 142–144, 147; 187/259
See application file for complete search history.

(56) References Cited

U.S. PATENT DOCUMENTS 1,348,138 A * 7/1920 Hunt ..... 182/37
3,087,178 A * 4/1963 Loomis ..... 14/71.3
3,627,397 A * 12/1971 Rominsky ..... 312/246
4,541,508 A * 9/1985 Lundh ..... 182/78
5,239,795 A * 8/1993 Breaux ..... 52/182
5,535,852 A * 7/1996 Bishop et al. ..... 187/336
6,131,702 A * 10/2000 Berridge ..... 187/259

* cited by examiner

*Primary Examiner*—Alvin Chin-Shue
(74) *Attorney, Agent, or Firm*—O'Melveny & Myers LLP

(57) ABSTRACT

A platform lift system includes a mounting frame that is fixedly engaged into a scuttle hole formed in a horizontal supporting surface (i.e., attic floor or room ceiling) and a foldable ladder that is supported by the frame. A separate trolley carries a lift platform that may be selectively raised or lowered in order to transport objects to/from the attic space. The trolley is moveable horizontally along a track that may be provided on a floor of the attic space. At a first end of travel of the trolley along the track, the trolley is disposed laterally alongside and vertically offset from the mounting frame such that the space above the mounting frame is unimpeded to permit a user to access the attic space using the deployed ladder. At a second end of travel of the trolley along the track, the trolley is aligned vertically with the mounting frame to permit use of the lift platform. The trolley further includes a drive system that controls the movement of a plurality of lift tethers that are coupled to the platform. The platform is raised by withdrawing the lift tethers, and is lowered by paying out the lift tethers. The ladder further includes a track that provides a guide for movement of a lift platform.

13 Claims, 13 Drawing Sheets

PLATFORM LIFT APPARATUS WITH INTEGRATED LADDER FOR ACCESSING ATTIC STORAGE SPACE

RELATED APPLICATION DATA

This patent application is a continuation of U.S. patent application Ser. No. 11/207,543 for PLATFORM LIFT APPARATUS WITH INTEGRATED LADDER FOR ACCESSING ATTIC STORAGE SPACE, filed Aug.19, 2005, now issued as U.S. Pat. No. 7,140,466, on Nov. 28, 2006, which is a continuation of U.S. Pat. application Ser. No. 10/814,395, filed Mar. 30, 2004, now U.S. Pat. No. 6,962,236. This patent application also relates to co-pending patent application Ser. No. 10/759,500, filed Jan. 16, 2004, for PLATFORM LIFT APPARATUS FOR ATTIC STORAGE SPACE, the subject matter of which is hereby incorporated by reference herein.

BACKGROUND OF THE INVENTION

1. Field of the Invention

The present invention relates to residential or commercial storage, or more particularly, to a platform lift apparatus for raising or lowering objects into a raised storage location such as an attic storage space located above a garage or living quarters, with an integrated ladder enabling a user to access the storage location through the same opening.

2. Description of Related Art

Many homes have attic spaces above garages and living quarters, and these attic spaces often provide a storage location for various items. While some attic spaces are finished and have access via a stairwell, most attic spaces remain unfinished and have more rudimentary access systems. The most basic access system is a simple opening or scuttle hole formed in the ceiling dividing the attic space from the room below. The scuttle hole is commonly located in a closet or main hallway, and may be covered by a hatch that comprises a removable portion of ceiling, such as formed from plywood or drywall. A user would position a ladder below the opening and access the storage space by carrying storage objects up and down the ladder. An improvement over this basic access system is a pull-down ladder that is built into a hingedly attached door covering the opening. The pull-down ladder may be folded into a plurality of sections to provide a compact structure when stowed. The user opens the door and unfolds the ladder to bring it into an operational position. This pull-down ladder has improved convenience since the user does not have to transport a ladder to and from the access location, and the ladder is anchored to the opening to thereby provide an increased degree of safety for the user.

Nevertheless, a drawback of each of these access systems is that it is difficult to transport objects up and down the ladder. The user cannot easily carry the object and grasp the ladder at the same time, thereby forcing a dangerous tradeoff between carrying capacity and safety. Moreover, the size and weight of the objects that may be transported is limited to that which could be manually carried and fit through the dimensions of the access opening. Users of such access systems have a substantial risk of injury due to falling and/or dropping objects, and the objects themselves can be damaged as well.

Thus, it would be advantageous to provide an improved way to transport objects to and from an attic storage space without the drawbacks of the known access systems.

SUMMARY OF THE INVENTION

The present invention overcomes the foregoing drawbacks of the prior art by providing a platform lift apparatus usable to safely move objects to and from an attic storage space. More particularly, the invention provides a platform lift system that includes an integrated, foldable ladder.

The platform lift system provides two distinct functions. First, the user can use the integrated ladder to personally access the attic space. Second, the user can selectively use the platform lift system to move objects between an attic space and a room below. The present invention is advantageous since a user would only have to provide a single scuttle hole through the ceiling to provide for both human access and movement of stored objects. It should be understood that the term "attic" broadly refers to a room or space disposed above a garage or living quarters of a house. While in most cases the attic comprises an uppermost space of the house located immediately below a roof, it should be appreciated that other raised spaces of a house, such as a loft, crawlspace, deck, balcony or patio, could also fall within a broad meaning of an attic as used in the present patent application.

In an exemplary embodiment of the invention, the platform lift system includes a mounting frame that is fixedly engaged into a scuttle hole formed in a horizontal supporting surface (i.e., attic floor or room ceiling) and a foldable ladder that is supported by the mounting frame. The mounting frame lies substantially flush with the ceiling floor, so as to maximize available storage space within the attic ceiling. The ladder is broken into sections that are folded upon one another within the mounting frame to provide a generally compact structure when stowed, and may be hingedly attached to the frame. When in the deployed position, the ladder sections are extended in alignment with each other to enable a user to access the attic space as with conventional attic access systems having a pull-down ladder.

A separate trolley carries a lift platform that may be selectively raised or lowered in order to transport objects to/from the attic space. The trolley is moveable horizontally along a track that may be provided on a floor of the attic space. At a first end of travel of the trolley along the track, the trolley is disposed laterally alongside and vertically offset from the mounting frame such that the space above the mounting frame is unimpeded to permit a user to access the attic space using the deployed ladder. At a second end of travel of the trolley along the track, the trolley is aligned vertically with the mounting frame to permit use of the lift platform. The trolley further includes a drive system that controls the movement of a plurality of lift tethers that are coupled to the platform. The platform is raised by withdrawing the lift tethers, and is lowered by paying out the lift tethers. The ladder further includes a track that provides a guide for movement of a lift platform. The platform further includes wheels extending from one edge thereof and adapted to engage the track provided by the ladder. The platform would be raised and lowered by traveling diagonally along the track provided by the ladder.

A more complete understanding of the platform lift system will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF PREFERRED EMBODIMENTS OF THE INVENTION

The present invention satisfies the need for an improved way to transport objects to and from an attic storage space without the drawbacks of the known access systems. In the detailed description that follows, like element numerals are used to describe like elements illustrated in one or more figures.

Referring to FIGS. 1-7, an exemplary platform lift system is shown in accordance with an embodiment of the invention. The exemplary platform lift system includes a mounting frame 12 formed in a generally rectangular shape having transverse ends and side members. The frame may be comprised of any suitable material, such as wood, plastic, metal or other high strength, lightweight material capable of supporting a suitable load carried by the platform lift system. The mounting frame 12 provides a mechanical structure that supports the other functional components of the platform lift system and provides a surface for mounting the platform lift system into a scuttle hole of an attic space (as will be further described below). The mounting frame 12 may further include a lip that provides a seal with the scuttle hole and that also provides a decorative border framing the scuttle hole.

Figure 1:
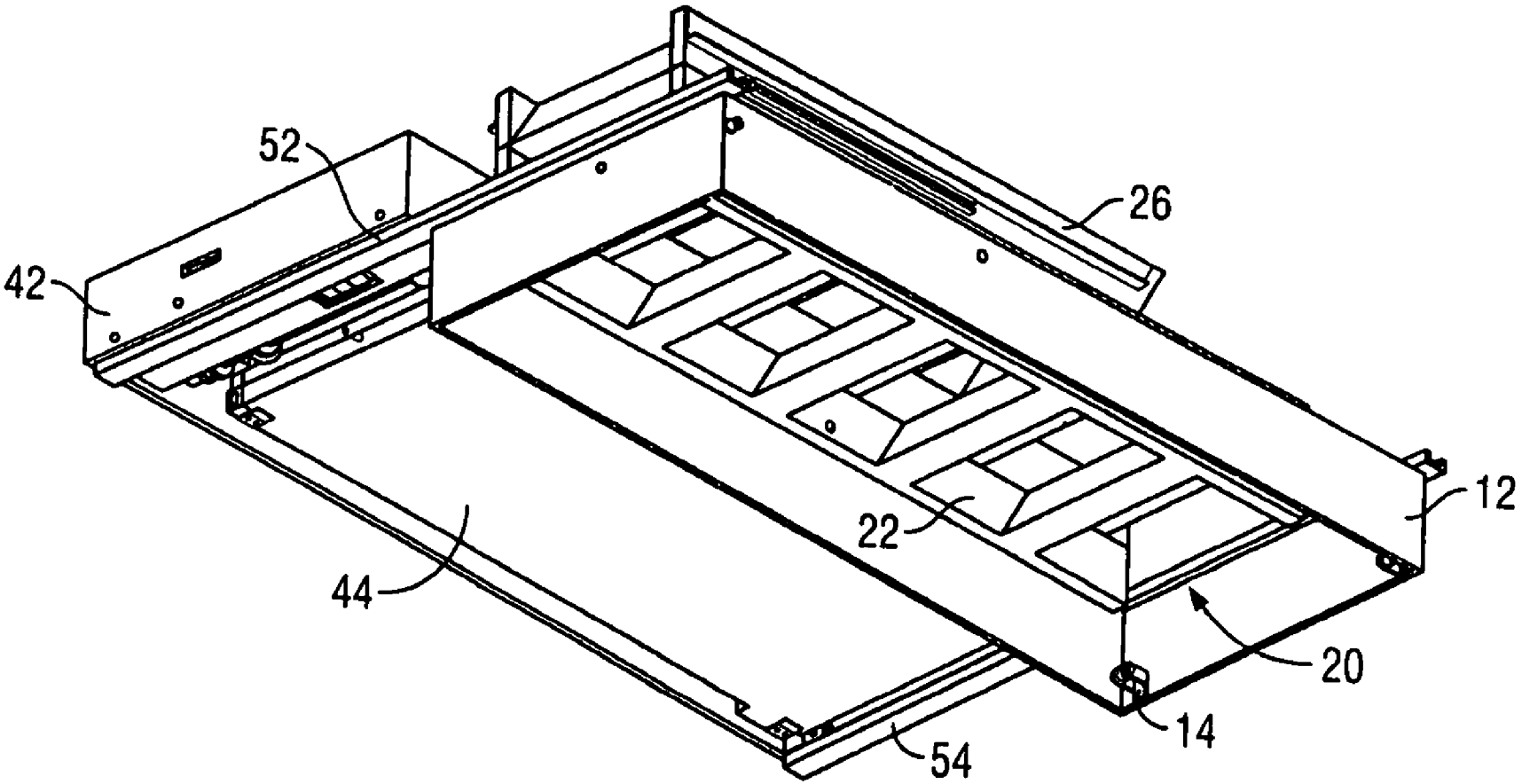
FIG. 1 is an isometric view from a bottom perspective of an exemplary platform lift system having an integrated ladder in a stowed position.
Figure 2:
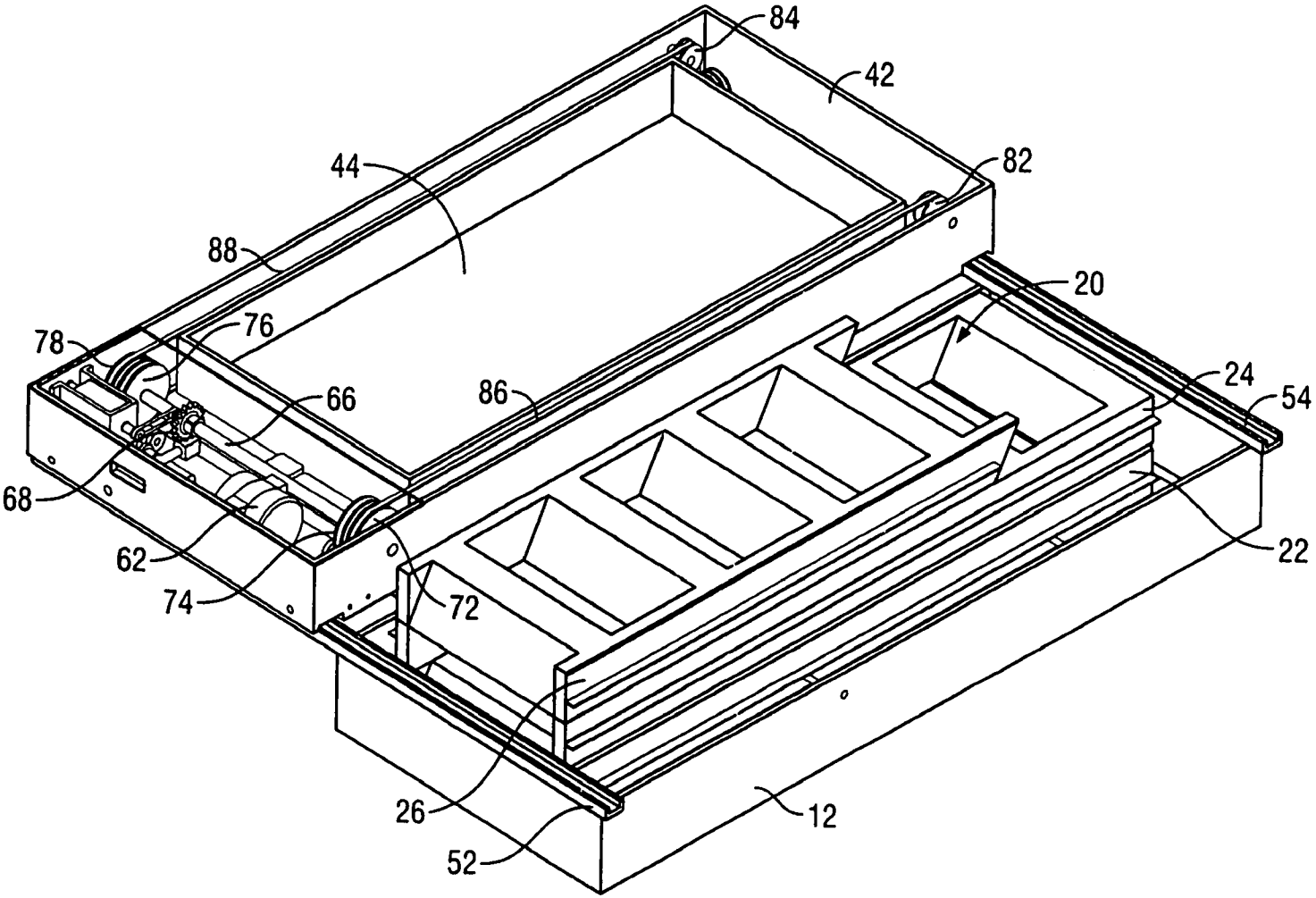
FIG. 2 is an isometric view from a top perspective of the exemplary platform lift system having an integrated ladder in a stowed position.
Figure 3:
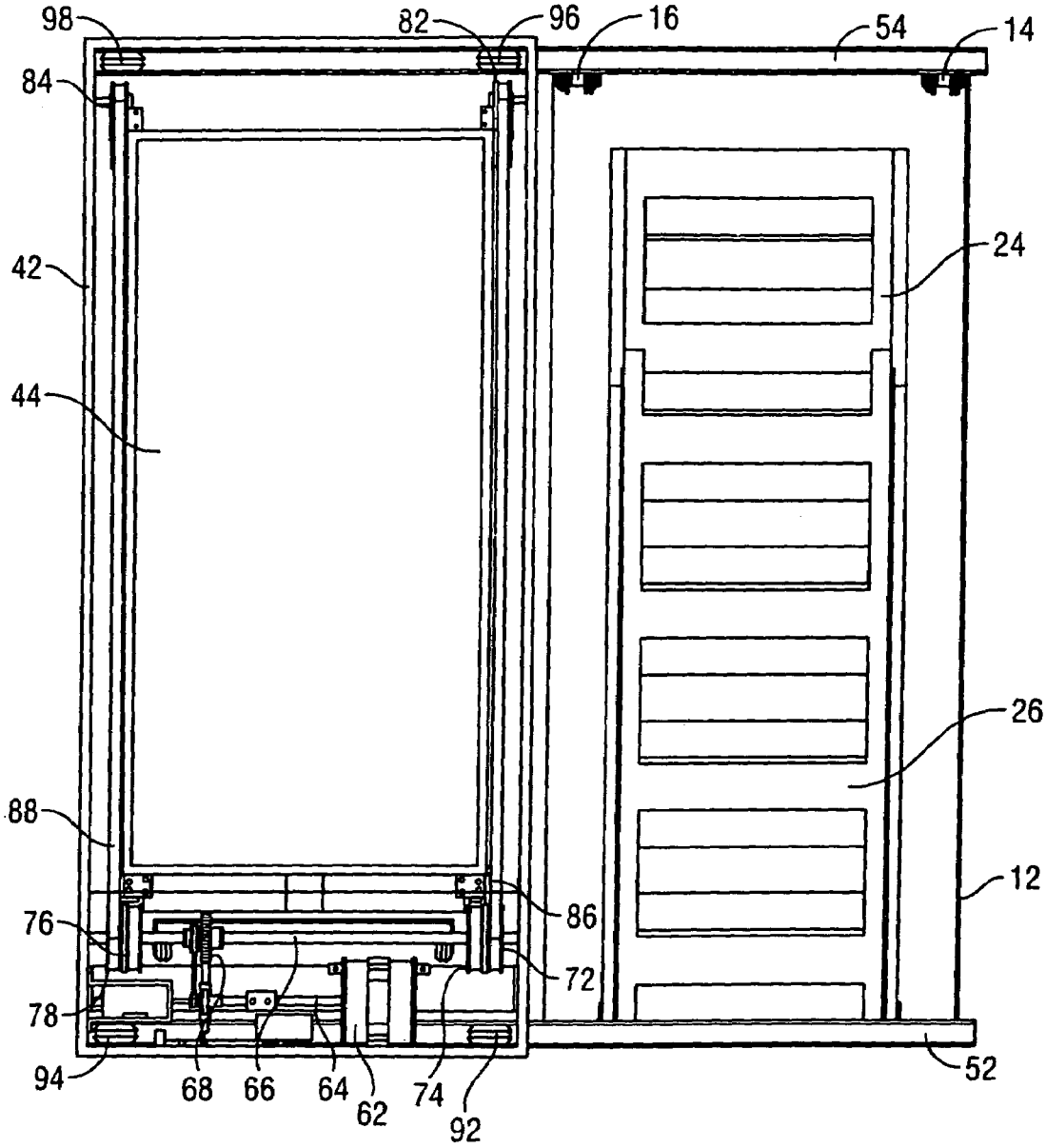
FIG. 3 is a top view of the platform lift system of FIGS. 1 and 2.
Figure 4:
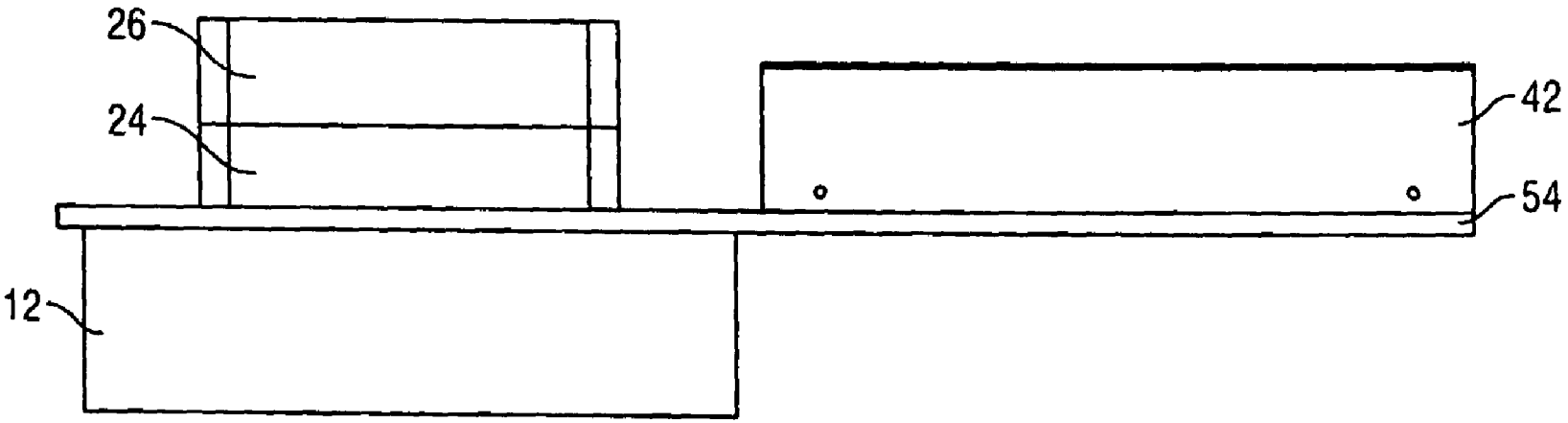
FIG. 4 is a side view of the platform lift system of FIGS. 1 and 2.

A fold-down ladder 20 is provided in the mounting frame 12. The ladder 20 is comprised of a plurality of sections 22, 24, 26 that are connected to each other by respective hinges. As shown in FIGS. 1-3, the ladder sections 22, 24, 26 are folded onto each other to permit the ladder to be stowed within the mounting frame 12 disposed in the scuttle hole and thereby enclosed in the ceiling when not in use. The folded ladder sections may extend slightly above the mounting frame 12 when stowed. A hatch door (not shown) is hingedly attached to the mounting frame 12 and closes the scuttle hole when the ladder is stowed in order to provide a seal between the attic space and the room below. Each of the ladder sections 22, 24, 26 includes a pair of side runners with a plurality of steps extending between the side runners. The ladder 20 may be comprised of suitable materials, such as wood or aluminum.

Figure 5A:
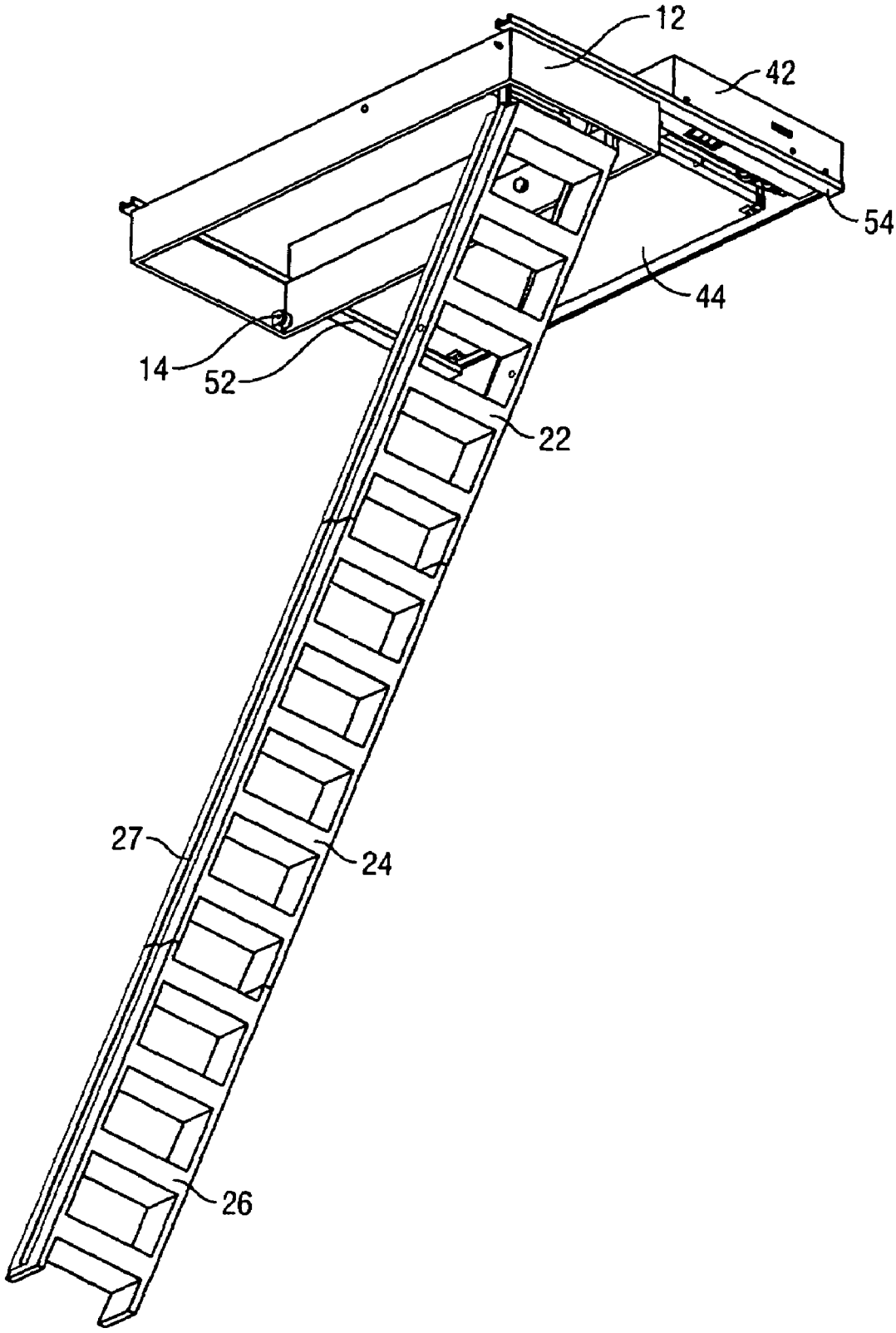
FIGS. 5A, 5B and 5C are isometric views from a bottom perspective of the exemplary platform lift system having an integrated ladder in a deployed position and the lift platform in stowed, raised and partially lowered positions, respectively.
Figure 5B:
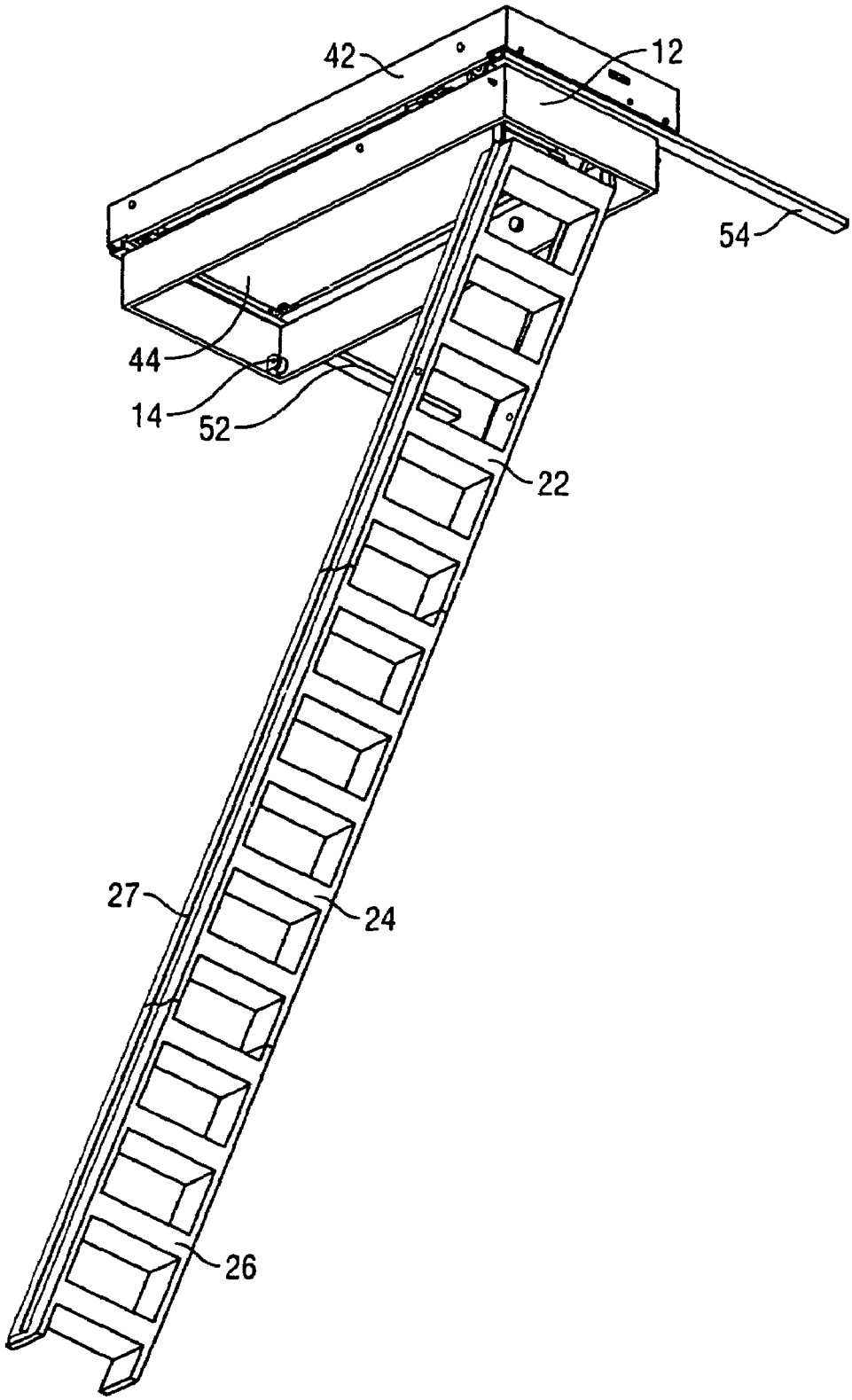

Section 22 of the ladder 20 is attached to one end of the mounting frame 12 by a suitable hinge, and may also be coupled to the hatch door such that the folded assemblage of ladder sections pivot downward as the hatch door is opened. Particularly, the ladder 20 may be deployed by a user opening the hatch door and unfolding the ladder sections 22, 24, 26 while pivoting them downward. When the ladder 20 is fully deployed, the ladder sections 22, 24, 26 become aligned and extend downward at an angle of roughly 60° with respect to horizontal and come into contact with the floor at the bottom of the ladder, as shown in FIGS. 5, 6, and 7. To return the ladder to the stowed configuration, the user reverses the deployment process by folding the ladder sections 22, 24, 26 while pivoting them upward along with the hatch door. The deployment and/or return of the ladder 20 may be performed as either a manual or automated operation. It should be appreciated that a three-section ladder 20 is described herein for exemplary purposes, but that other deployable ladder configurations having a greater or lesser number of sections could also be advantageously utilized. Such deployable ladders are well known in the art.

A trolley 42 is moveable horizontally with respect to the mounting frame 12. A pair of tracks 52, 54 extend horizontally along the floor of the attic space. Each exemplary track 52, 54 comprises an elongated channel that extends parallel to the respective ends of the mounting frame 12. The tracks 52, 54 are coextensive with the length of the ends of the mounting frame 12, and extend laterally beyond one side of the mounting frame ends (see e.g., FIG. 4). The trolley 42 includes a plurality of wheels 92, 94, 96, 98, with each being disposed in a respective corner of the trolley. A first pair of the wheels 92, 94 are oriented to travel within track 52, and a second pair of the wheels 96, 98 are oriented to travel within track 54. The trolley 42 is moveable along the length of the tracks 52, 54. It should be appreciated that the tracks 52, 54 may be selectively oriented to extend either to the left or the right of the mounting frame 12, depending upon the specific shape of the attic space and orientation of the scuttle hole within the attic space. Likewise, the tracks 52, 54 may be oriented to extend from the front or rear end of the mounting frame 12, with the wheels 92, 94, 96, 98 oriented accordingly. The channel of the tracks 52, 54 may have any suitable shape, such as a U-shape or V-shape, with the wheels 92, 94, 96, 98 have a corresponding shape. One or more of the wheels 92, 94, 96, 98 may be driven by a motor (not shown) in order to drive the trolley 42 horizontally along the tracks. Alternatively, the wheels 92, 94, 96, 98 may be free-wheeling to permit manual horizontal movement of the trolley 42. In yet another alternative embodiment, the tracks 52, 54 may be raised above the attic floor, and the trolley 42 may be suspended below the tracks.

More specifically, the trolley 42 is moveable horizontally by cooperation of the wheels 92, 94, 96, 98 and the track 52, 54 between a first end position in which the trolley 42 is laterally moved entirely out of the way of the mounting frame 12 (as shown in FIGS. 1-4) and a second end position in which the trolley 42 is overlapping the mounting frame 12 (as shown in FIGS. 5A, 5B, 6A, 6B). While in the first end position, the ladder 20 may be deployable as substantially described above, with the trolley 42 permitting unimpeded access by a user into the attic space. Conversely, while in the second end position, and with the ladder 20 deployed, the trolley 42 is oriented to allow selective movement of a lift platform, as will be described below.

The trolley 42 may further include sensing devices, such as microswitches, that detect that it has reached the first or second end position of the track 52, 54, and which provides a corresponding signal to control circuitry for the platform lift system. The sensing devices may be affixed to the trolley 42, and come into contact with an actuator affixed to each end of at least one of the tracks 52, 54. Alternatively, the locations of the sensing devices and actuators may be reversed, with the sensing devices disposed at the ends of the tracks 52, 54 and the actuator affixed to the trolley 42. Other known position sensing devices could also be advantageously utilized.

Figure 5C:
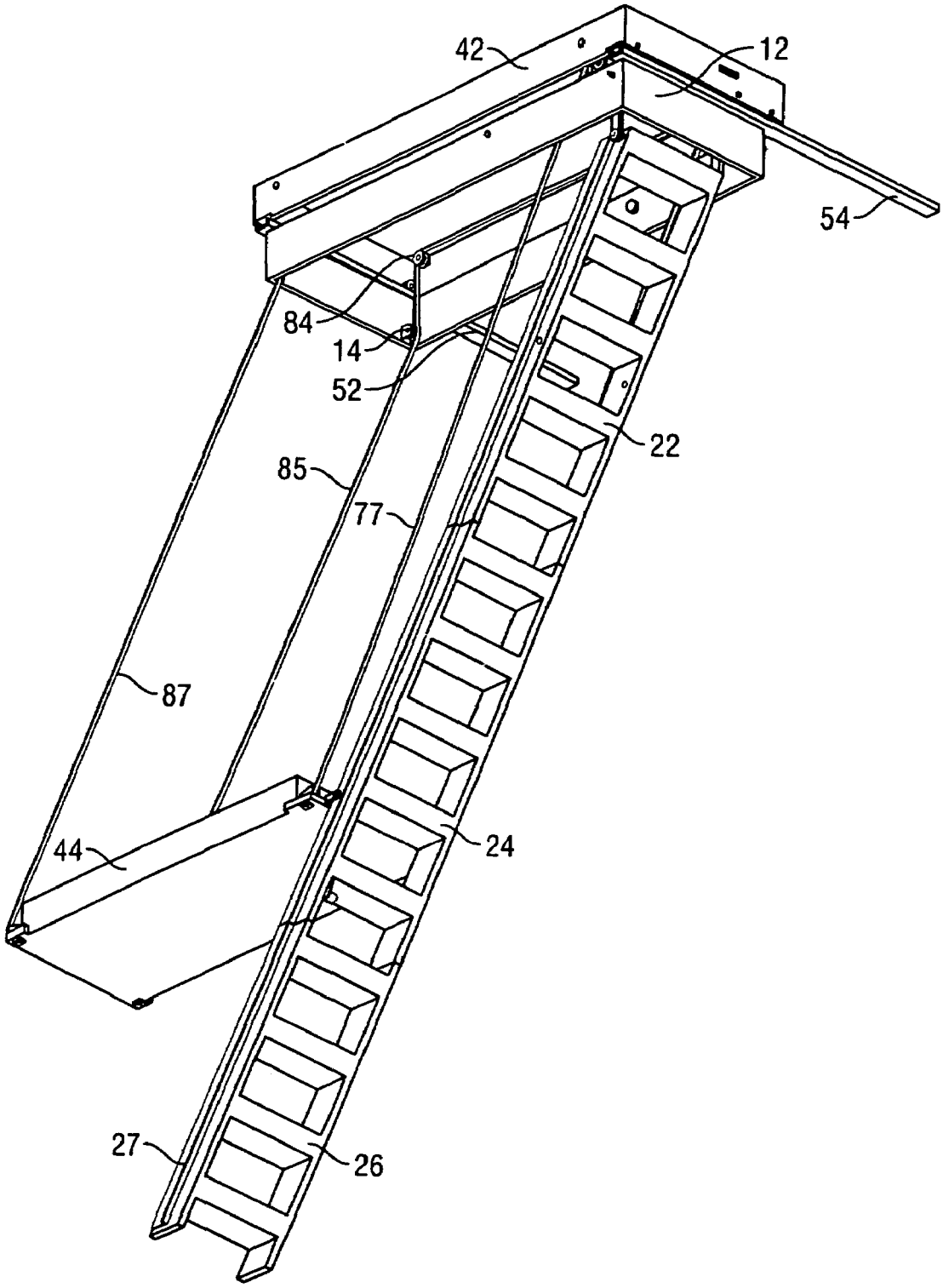
Figure 6A:
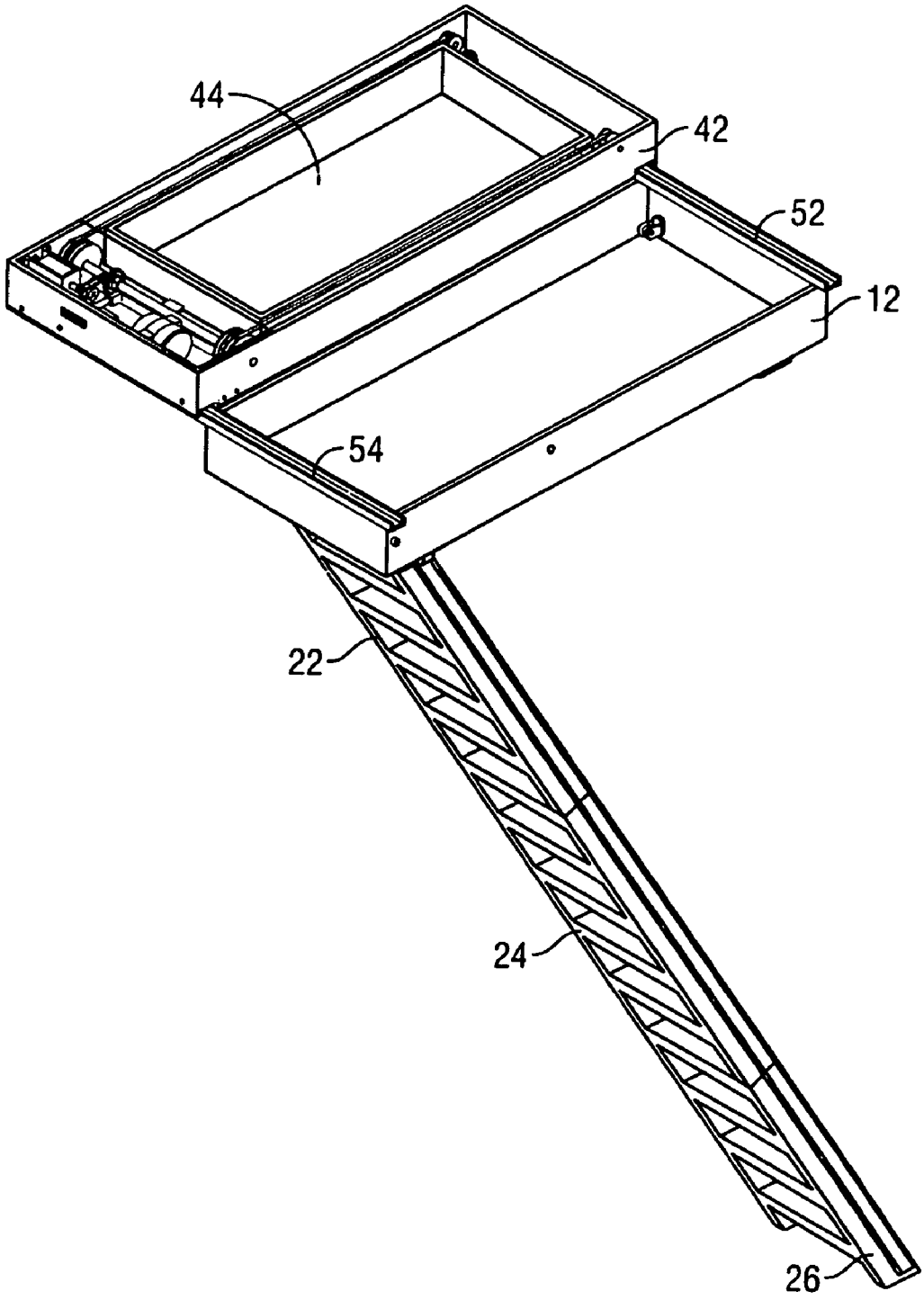
FIGS. 6A, 6B and 6C are isometric views from a top perspective of the exemplary platform lift system having an integrated ladder in a deployed position and the lift platform in stowed, raised and partially lowered positions, respectively.
Figure 6B:
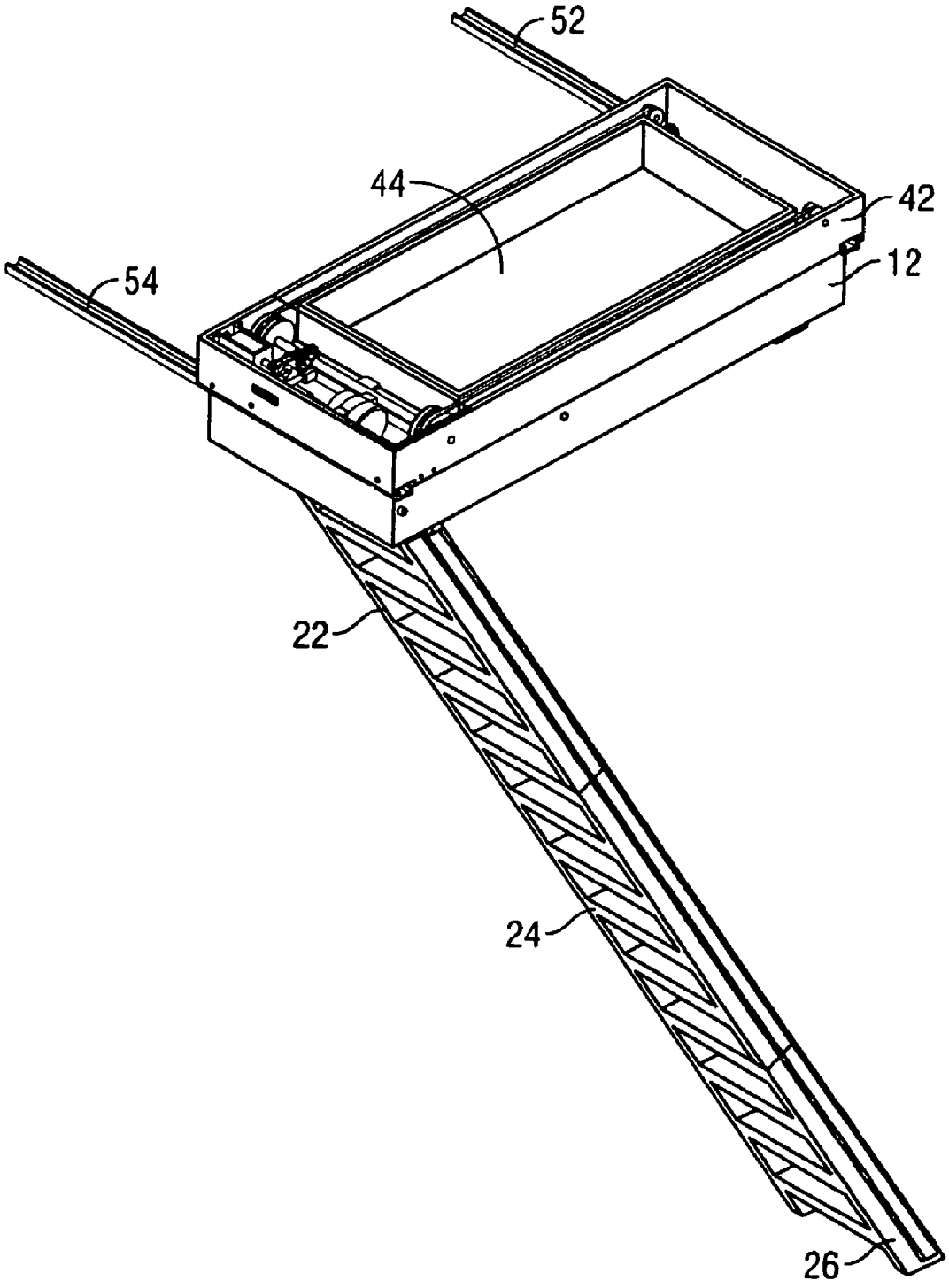
Figure 6C:
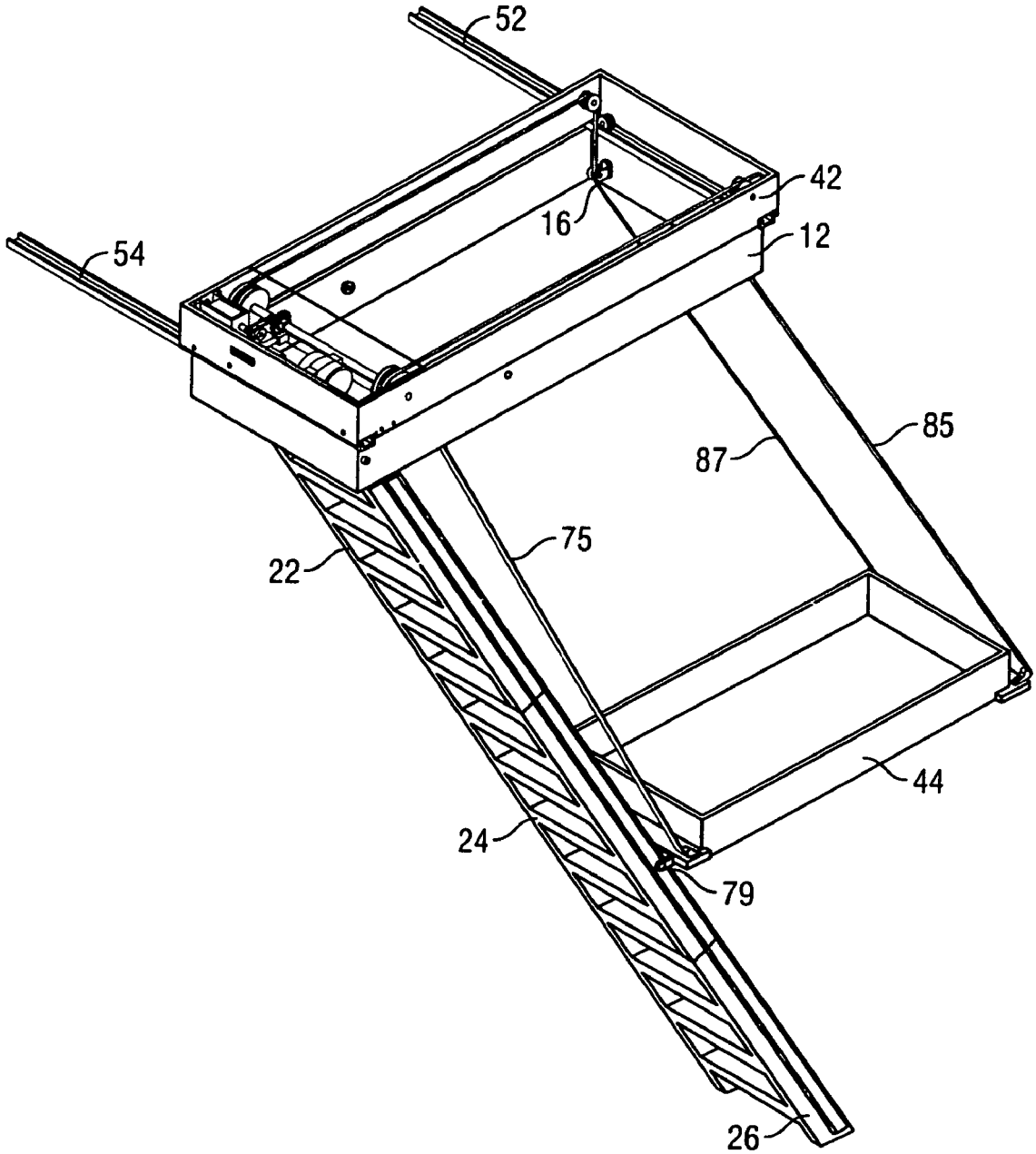
Figure 7:
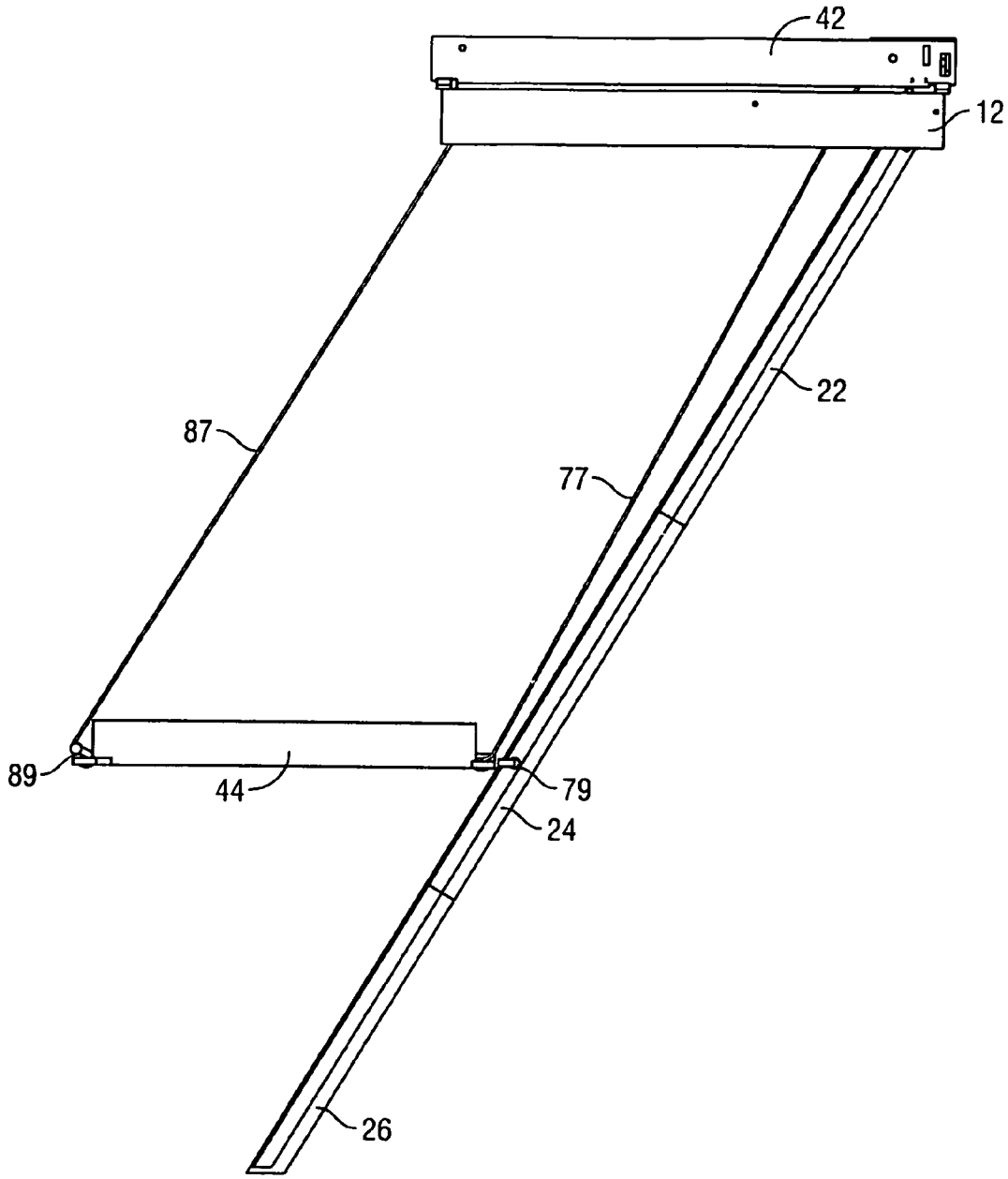
FIG. 7 is a side view of the exemplary platform lift system having an integrated ladder in a deployed position and the lift platform in a partially lowered position.

The trolley 42 carries a drive system that raises and lowers a lift platform 44 by operation of lift tethers 75, 77, 85, 87 (as shown in FIGS. 5C, 6C). The lift platform 44 comprises a horizontal base having a generally rectangular shape with ends of the lift tethers 75, 77, 85, 87 joined to the base at adjacent corners thereof. The lift platform 44 may further comprise a vertically oriented wall extending upward from the base and arranged in a rectangular shape to enclose a carrying space. The wall provides a barrier to prevent objects from falling off the platform 44 as it is raised and lowered. It is anticipated that the barrier function could be adequately achieved with the wall extending upward by only a small distance (e.g., less than two inches), although other shapes and dimensions for the wall could also be advantageously utilized. When the lift platform 44 is fully raised upward, the wall nests substantially within the space defined by the trolley 42 and may extend slightly above or below the upper surface of the trolley.

An exemplary drive system includes shaft 66 that is rotatably mounted to the trolley 42. The shaft 66 is oriented horizontally with respect to the trolley 42 and lift platform 44, and is disposed adjacent to a first end of the trolley 42. The trolley 42 may further include a collet and/or bearing assembly associated with each end of the shaft 66 to engage the shaft end and thereby reduce its rotational friction. Shaft 66 carries drive pulley 72 and lift drum 74 disposed alongside each other at a first end thereof and lift drum 76 and drive pulley 78 disposed alongside each other at a second end thereof. The drive pulleys 72, 74 are disposed peripherally outward along the shaft 66 adjacent to the trolley 42. At the other end of the trolley 12, lift drums 82, 84 are aligned with drive pulleys 72, 74, respectively. The drive pulleys 72, 74 are mechanically coupled to the lift drums 82, 84, by respective drive belts 86, 88, such that the drive pulleys 72, 74 drive the lift drums 82, 84 in unison. It should be appreciated that alternative arrangement of the drive pulleys and lift drums could also be advantageously utilized.

The lift drums 74, 76, 82, 84 are coupled to respective lift tethers 75, 77, 85, 87. A first end of each lift tether is fixedly attached to a respective lift drum and the tether is thereby wound onto the drum. A second end of the lift tether hangs vertically from the drum and is attached to the lift platform 44. The lift tethers may be comprised of any relatively flexible material that is capable of winding about a drum or spool and of being fastened at both ends. For example, the lift tethers may be comprised of a braided cord, band or webbing of nylon fibers or like materials providing high strength with minimal stretch and light weight. Other suitable materials may include rubber, plastic, metal cables or linked chains. The lift drums would be selected having a shape adapted to match the specific type of lift tether material selected. By way of example, if a cable material were selected for the lift tether, then a grooved lift drum would be employed to guide the cable upon retraction so that the cable does not overlap upon itself. Selection of an appropriate combination of lift tether and lift drum is considered within the ordinary level of skill in the art.

It should be appreciated that the drive belts may further include mating teeth at an inner surface thereof, and the drive pulleys may further comprise sprockets, cogs or gears that engage the teeth to maintain synchronized rotation of the lift drums and thereby eliminate slippage between belts and pulleys. The term "drive pulley" is therefore intended to broadly encompass any mechanical member coupled to an associated shaft for guiding or translating between axially rotational and linear movement, and the term "drive belt" is intended to encompass any type of elongated flexible material, such as cloth webbing, leather, artificial and natural fiber, metal (e.g., chain or cable), and the like, used to transmit motion under control of one or more "drive pulleys." By way of example, the drive belts may be formed of the same material as the lift tethers.

Motor 62 is mounted to the trolley 42 using suitable brackets and is adapted to drive the shaft 66 through suitable mechanical interconnection. In the exemplary embodiment, motor 62 drives motor shaft 64, which in turn drives a helical gear that is in mesh with helical gear affixed to a worm shaft oriented 90° to the motor shaft. The worm shaft carries worm that is arranged in mesh with the shaft drive worm gear 68 coupled to shaft 66. The shaft 66 drives the lift drums that raise and lower the lift tethers. It should be appreciated that a wide variety of gear train arrangements can be selected to achieve a desired gear reduction ratio (e.g., 30:1) combined with optimal packaging efficiency. Similar gear ratios and packaging efficiencies can be achieved by use of one or more of the following approaches: conventional gear trains, planetary gearing, and harmonic/cyclic gearing. The required gear ratio could also be reduced by selection of a lower speed, higher torque motor. In another embodiment, the motor output torque could be selected to match the torque requirements by driving the shaft 66 directly (i.e., without a gear train). The motor 62 could then be mounted centrally on the shaft 66, with the motor shaft extending from both ends of the motor. The drive pulleys and lift drums could then be mounted onto opposite ends of the shaft.

Accordingly, when motor 62 is driven to rotation in a first direction, shaft 66 will be driven to rotation in a corresponding direction to unwind the lift tethers from the respective lift drums and thereby lower the platform. Conversely, when motor 62 is driven to rotation in a second (opposite) direction, shaft 66 will be driven to rotation in a corresponding direction to rewind the lift tethers onto the lift drums and thereby raise the platform. In a preferred embodiment of the invention, the shaft 66 is keyed to match associated keying of the drive pulleys, lift drums, and shaft drive gear 68 so as to maintain synchronized movement.

It will be appreciated that the platform lift system will include suitable control circuitry for activating the motor 62 in forward and reverse directions. The control circuitry may further include certain protective and safety features. For example, the control circuitry may detect that the trolley 42 is at the second end position before permitting operation of the drive system to move the lift platform 44. The control circuitry may also be adapted to detect excess force (i.e., weight) and/or current draw, detection of blockage of the travel path via interruption of a light beam, and/or mechanical or electronic counter to determine if either the full travel distance has been accomplished and/or the rotational speed of the motor falls below a specified limit. The lift platform 44 may also include a locking mechanism or pawl that locks the platform in the fully raised position. The locking mechanism may be disengaged automatically, such as using a solenoid, when it is desired to lower the platform.

Figure 9:
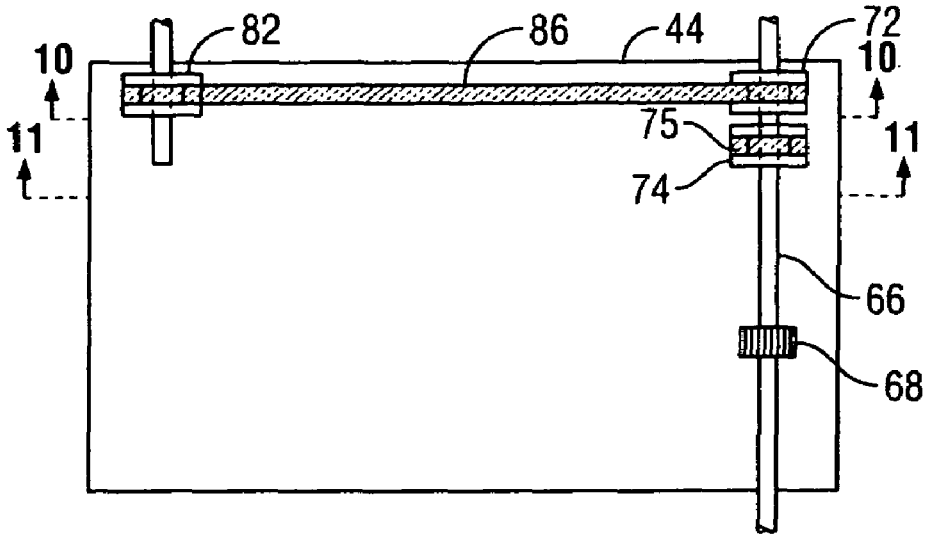
FIG. 9 is a top view of an exemplary drive system for the platform lift system.
Figure 10:
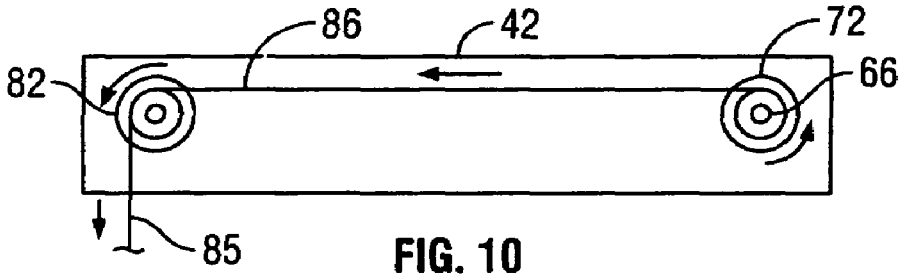
FIG. 10 is a side view of the exemplary platform lift drive system as taken through the section 10-10 of FIG. 9.
Figure 11:
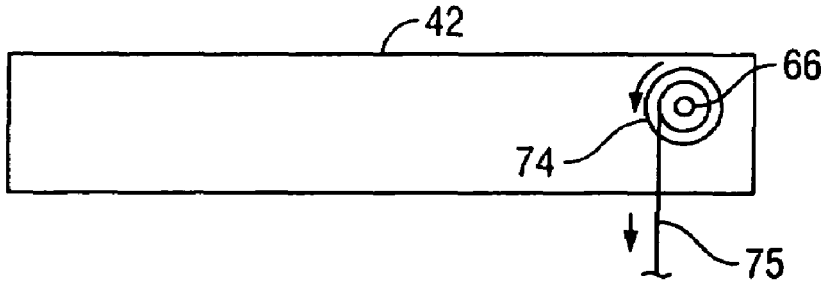
FIG. 11 is another side view of the exemplary platform lift drive system as taken through the section 11-11 of FIG. 9.

Referring now to FIGS. 9-11, an embodiment of the drive system for the platform lift system is shown in greater detail. FIG. 9 shows a top view of a portion of the drive system having shaft 66 used to raise and lower lift platform 44. FIG. 10 shows a side sectional view of the drive system and trolley 42 as taken through the section 10-10 of FIG. 9, and FIG. 11 shows a side sectional view of the drive system and trolley 42 as taken through the section 11-11 of FIG. 9. Shaft 66 carries drive pulley 72 and lift drum 74. The lift drum 74 has lift tether 75 coupled thereto. Lift drum 82 is aligned with drive pulley 72. Drive gear 68 is carried by shaft 66 and driven by a suitable drive mechanism (not shown).

The drive belt 86 has a first end fixedly attached to drive pulley 72 and a second end that is carried partly by the idler lift drum 82 and then extends vertically to provide a lift tether 85. When the lift platform 44 is fully raised, the drive belt 86 is wound onto the belt drive pulley 72 and when the platform is fully lowered the drive belt is completely paid out. The drive belt 86 causes the belt drive pulley 72 and the idler lift drum 82 to rotate in the same direction. Counterclockwise rotation of lift drum 74 (as seen in FIGS. 10 and 11) in unison with belt drive pulley 72 pays out lift tether 75. It should be appreciated that the drive system will also include another lift drum and belt drive pulley pair at the other end of shaft 66, and another idler lift drum aligned with the additional belt drive pulley, but these are omitted from FIG. 9 to simplify the drawing. Additional drive system embodiments are described in co-pending patent application Ser. No. 10/759,500, filed Jan. 16, 2004, for PLATFORM LIFT APPARATUS FOR ATTIC STORAGE SPACE.

Returning again to FIGS. 5A-5C and 6A-6C, the platform lift system is shown in various modes of operation. FIGS. 5A and 6A show the ladder 20 fully deployed with the trolley 42 moved laterally out of vertical alignment with the mounting frame 12. While in this mode, the user is free to use the ladder to access the attic space without interference by the trolley 42. Notably, FIG. 5A shows the trolley 42 moved laterally to the right of the mounting frame 12, while FIG. 5B shows the trolley 42 moved laterally to the left of the mounting frame 12. As discussed above, a user can select either arrangement, and that has no effect on the operation of the attic lift system. It should also be appreciated that the trolley 42 could also be moveable in other lateral directions, such as extending from the ends of the mounting frame 12 in a direction perpendicular to the direction shown in the figures.

FIGS. 5B and 6B show the trolley 42 moved laterally so that it is overlapping and vertically aligned with the mounting frame 12. At this time, the lift platform 44 is disposed within the trolley 42 and is suspended over the scuttle hole in a fully raised position. It should be appreciated that the user would not be able to access the attic space at this time. With the lift platform 44 in this position, a user can load objects onto the lift platform 44 for transport to the floor below. As discussed above, the trolley 42 may further include a locking pawl to securely maintain the lift platform 44 in this fully raised position while loads are placed onto the lift platform.

Lastly, FIGS. 5C and 6C show the lift platform 44 lowered partially toward the floor by operation of the drive system described above. The mounting frame 12 further includes a pair of guide rollers 14, 16 that provide a guide for the rear lift tethers 85, 87, respectively. The guide rollers 14, 16 facilitate the paying out of the lift tethers 85, 87, as the direction of travel of the lift platform transitions from vertical to diagonal. The lift platform 44 may also include tether guides 89 (see FIG. 4) that extend from a rear end thereof to facilitate attachment between the tethers 85, 87 and the lift platform. The lift platform 44 further includes a pair of roller guides 79, 81 that extend from a front end thereof. The ladder 20 further includes a guide track 27 that extends the length of the ladder. Accordingly, when the lift platform 44 is lowered, the roller guides 79, 81 engage and maintain contact with the guide track 27, which guides the platform downward in a substantially diagonal direction in an angle defined by the orientation of the ladder 20. The platform 44 will continue to descend along a track defined by the guide track 27 until reaching the floor or being selectively stopped by the user.

Figure 8:
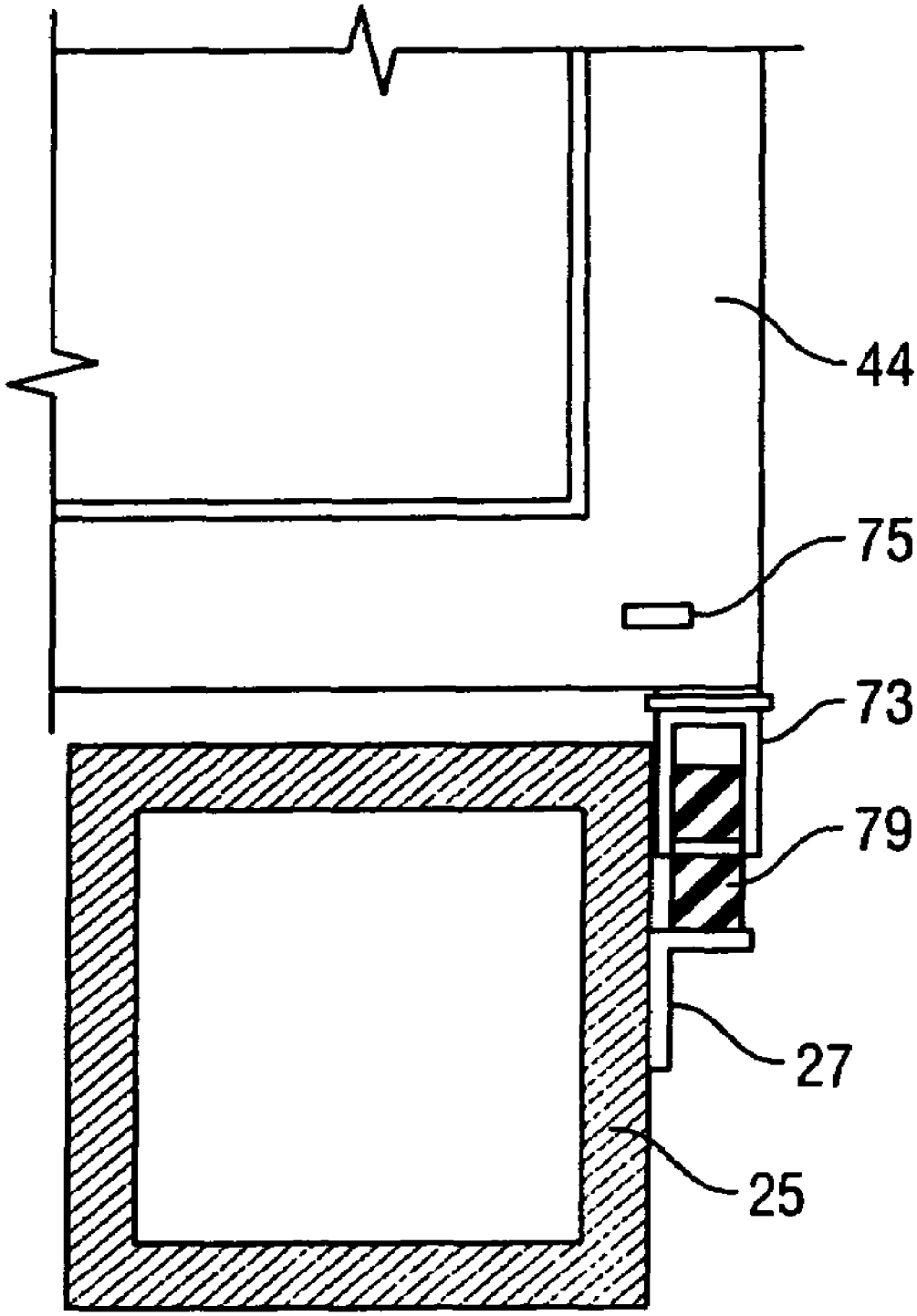
FIG. 8 is a partial sectional view of a ladder side runner having a track to guide movement of the lift platform.

FIG. 8 illustrates the engagement between the roller guide 79 and the guide track 27 in greater detail in accordance with an embodiment of the invention. The guide track 27 is affixed to an outer surface of the side runner 25 of the ladder 20 (shown in cross-section). As illustrated in FIG. 8, the guide track 27 comprises a generally L-shaped rail having a surface that engages the roller guide 79. The roller guide 79 comprises a wheel that is secured to an edge of the lift platform 44 by a suitable bracket 73. It should be appreciated that other shapes and arrangements for the guide track could also be advantageously utilized. In a particular embodiment, the roller guide 79 could be arranged to roll along the facing surface of the ladder side runner 25, thereby eliminating the need for a separate guide track altogether. The roller guide 79 could further have a shape that corresponds with the front surface of the ladder side runner 25. For example, if the side runner has a front surface with a curved shape, the roller guide 79 would be arranged with a corresponding shape. It should be appreciated that the engagement between the roller guide 79 and the ladder 20 provides generally good stability for the lift platform 44 as it is raised or lowered.

It should be appreciated that the present platform lift system could be implemented as a retrofit to an existing installed pull-down ladder. A retrofit kit would include the trolley 42 containing the lift platform 44 and drive system, and a pair of tracks 52, 54. The tracks 52, 54 would be attached to the attic floor in alignment with ends of the pull-down ladder mounting frame (as substantially described above). Depending upon the configuration of the pull-down ladder, a guide track 27 may be attached to sides of the side runners of the ladder. This retrofit kit would thereby enable existing pull-down ladders to be integrated with the platform lift system to provide the advantages and benefits discussed above.

Having thus described a preferred embodiment of a platform lift system with integrated ladder, it should be apparent to those skilled in the art that certain advantages have been achieved. It should also be appreciated that various modifications, adaptations, and alternative embodiments thereof may be made within the scope and spirit of the present invention.

What is claimed is:

1. A platform lift apparatus, comprising:

a mounting frame adapted to be installed in a ceiling;

a foldable ladder coupled to the mounting frame, the foldable ladder having a stowed condition and a deployed condition; and a trolley comprising a drive mechanism including a plurality of lift drums each having an associated lift tether at least partially wound thereon, and a lift platform coupled to each end of said plurality of lift tethers so as to be carried by said trolley, said trolley being moveable laterally with respect to said mounting frame between a first position offset from said mounting frame and a second position aligned vertically with said mounting frame;

wherein, upon said ladder being in the deployed condition and said trolley in said second position, said lift platform is selectively movable along a length of said ladder by operation of said drive mechanism.

2. The platform lift apparatus of claim 1, wherein at least a portion of said lift platform maintains contact with said ladder while moving along said length of said ladder.

3. The platform lift apparatus of claim 1, wherein said ladder further comprises at least one guide rail extending along said length of said ladder, said lift platform further comprises at least one wheel that maintains contact with said at least one guide rail while moving along said length of said ladder.

4. The platform lift apparatus of claim 3, wherein said at least one guide rail further comprises a bracket coupled to at least one side of said ladder.

5. The platform lift apparatus of claim 1, wherein said lift platform further comprises at least one wheel that maintains contact with a surface of said ladder while moving along said length of said ladder.

6. The platform lift apparatus of claim 1, wherein said mounting frame further comprising at least one track extending laterally therefrom, said trolley further comprising at least one wheel oriented to travel within said at least one track to permit lateral movement of said trolley between said first and second positions.

7. The platform lift apparatus of claim 6, wherein said at least one track further comprises a channel having a shape corresponding to that of said at least one wheel.

8. The platform lift apparatus of claim 1, wherein said drive mechanism further comprises at least one shaft carrying at least one of said plurality of lift drums.

9. The platform lift apparatus of claim 8, wherein said drive mechanism further comprises an electric motor operatively coupled to said at least one shaft.

10. The platform lift apparatus of claim 8, wherein at least one of said plurality of lift drums further comprises an idler lift drum operatively coupled to said at least one shaft.

11. The platform lift apparatus of claim 1, wherein said lift tether further comprises a braided or webbing material.

12. The platform lift apparatus of claim 1, wherein said ladder further comprises a plurality of ladder sections folded on top of one another when stowed.

13. The platform lift apparatus of claim 1, wherein said ladder extends in a generally diagonal direction when deployed, said lift platform being selectively movable in said diagonal direction along said length of said ladder by operation of said drive mechanism.

* * * * *